US009289082B1

(12) United States Patent
White et al.

(10) Patent No.: US 9,289,082 B1
(45) Date of Patent: Mar. 22, 2016

(54) PILLOW

(71) Applicants: Kenneth Samuel White, Wilmington, NC (US); Heidi Dion, Teachey, NC (US)

(72) Inventors: Kenneth Samuel White, Wilmington, NC (US); Heidi Dion, Teachey, NC (US)

( * ) Notice: Subject to any disclaimer, the term of this patent is extended or adjusted under 35 U.S.C. 154(b) by 0 days.

(21) Appl. No.: 14/832,392

(22) Filed: Aug. 21, 2015

Related U.S. Application Data

(60) Provisional application No. 62/070,468, filed on Aug. 27, 2014.

(51) Int. Cl.
*A47C 20/00* (2006.01)
*A47G 9/10* (2006.01)

(52) U.S. Cl.
CPC ..... *A47G 9/10* (2013.01); *A47G 2009/1018* (2013.01)

(58) Field of Classification Search
CPC .. A47G 9/10; A47G 2009/1018; A47G 9/109
See application file for complete search history.

(56) References Cited

U.S. PATENT DOCUMENTS 4,118,813 A 10/1978 Armstrong
4,550,458 A * 11/1985 Fiore ..... A47G 9/10 297/393
4,788,728 A * 12/1988 Lake ..... A47G 9/10 5/490
4,908,893 A 3/1990 Smit
5,528,784 A 6/1996 Painter
D388,648 S 1/1998 Bates
5,781,947 A * 7/1998 Sramek ..... A47G 9/10 5/636
5,848,448 A 12/1998 Boyd
6,006,380 A * 12/1999 Sramek ..... A47G 9/10 5/636
6,408,468 B1 * 6/2002 Comfort ..... A47G 9/10 5/498
6,622,325 B1 9/2003 Garza
6,629,324 B1 * 10/2003 Shapiro ..... A47G 9/10 5/630
6,637,058 B1 10/2003 Lamb
D576,438 S 9/2008 Peart
8,161,588 B1 * 4/2012 Anson ..... A47G 9/109 5/630
D669,725 S 10/2012 Blake
D670,947 S 11/2012 Williamson
8,572,780 B1 * 11/2013 Watters ..... A47G 9/1054 5/490
8,707,485 B1 * 4/2014 Conley ..... A47G 9/109 5/490
2002/0050007 A1 * 5/2002 Kim ..... A47G 9/10 5/636
2002/0138907 A1 * 10/2002 Wang ..... A47G 9/10 5/636
2005/0102757 A1 * 5/2005 Lee ..... A47G 9/10 5/636
2006/0016011 A1 * 1/2006 Berg ..... A47G 9/10 5/636
2007/0006382 A1 * 1/2007 Guez ..... A47G 9/10 5/638
2008/0086818 A1 * 4/2008 Sramek ..... A47G 9/10 5/636
2009/0139031 A1 * 6/2009 Davis ..... A47G 9/10 5/639
2010/0175193 A1 * 7/2010 Oh ..... A47C 27/14 5/638
2011/0094033 A1 * 4/2011 Lee ..... A61F 5/56 5/636
2012/0073057 A1 * 3/2012 Sramek ..... A47G 9/109 5/645
2012/0079660 A1 4/2012 Chen
2012/0180220 A1 * 7/2012 Popitz ..... A47G 9/1081 5/638

(Continued)

*Primary Examiner* — David E Sosnowski

(57) ABSTRACT

A pillow for supporting a person's head comprises an ear depression having an ear depression surface and shaped to hold an ear, the ear depression disposed 2 to 3 inches from a lateral edge of the pillow and an angled lateral margin between the ear depression and the lateral edge, the angled lateral margin having an angled lateral margin surface lying above said ear depression surface, the angled lateral margin disposed to support a face when an ear is disposed in the ear depression.

3 Claims, 3 Drawing Sheets

(56) References Cited

U.S. PATENT DOCUMENTS

2012/0186022 A1 7/2012 Navarro
2012/0255126 A1* 10/2012 Abdo ..... A47G 9/1009 5/638
2013/0047339 A1* 2/2013 Kim ..... A47G 9/109 5/637
2014/0000035 A1* 1/2014 Berg ..... A47G 9/10 5/636
2014/0033438 A1* 2/2014 Chen ..... A47G 9/109 5/636
2014/0208515 A1* 7/2014 Sramek ..... A47G 9/109 5/640
2014/0317849 A1* 10/2014 Legrand ..... A47G 9/1045 5/636
2014/0317851 A1* 10/2014 Hammack ..... A47G 9/10 5/640
2014/0317852 A1* 10/2014 Chen ..... A47G 9/109 5/644
2015/0089743 A1* 4/2015 Haworth ..... A47G 9/1036 5/640
2015/0216334 A1* 8/2015 Brouqueyre ..... A47G 9/1045 5/643

* cited by examiner

PILLOW

The present application claims the benefit of U.S. Provisional Application No. 62/070,468 filed on Aug. 27, 2014 which is incorporated by reference herein in its entirety.

BACKGROUND

The present invention generally relates to pillows, and more particularly to providing a pillow which prevents pressure from being applied to the cheek and frontal jaw.

Plastic surgery patients with a history of sleeping on their side or stomach using conventional pillows often need facelift procedures and other rejuvenation procedures at a young age. The results of these procedures on such patients aged faster than results on patients who were back sleepers. However, not everyone can consistently sleep on their back. Therefore, it would be advantageous to provide a pillow which aids side sleepers, especially before and after facial surgery and other facial procedures.

SUMMARY

In one aspect, a pillow for supporting a person's head comprises an ear depression having an ear depression surface and shaped to hold an ear, the ear depression disposed 2 to 3 inches from a lateral edge of the pillow and an angled lateral margin between the ear depression and the lateral edge, the angled lateral margin having an angled lateral margin surface lying above said ear depression surface, the angled lateral margin disposed to support a face when an ear is disposed in the ear depression.

In another aspect, the angled lateral margin provides support for the face without touching anterior facial surfaces of the mandible and neck.

In another aspect, the angled lateral margin is disposed to support the head along a line from the forehead, inferiorly through the temporal region and the angle of the mandible, to the lateral neck.

In another aspect, the ear depression is disposed 2.3 to 2.7 inches from the lateral edge of the pillow.

In another aspect, the ear depression is disposed 2.5 inches from the lateral edge of the pillow.

In another aspect, the pillow is generally shaped like a trapezoid.

A more complete understanding of the present invention, as well as further features and advantages of the invention, will be apparent from the following detailed description and the accompanying drawings.

DETAILED DESCRIPTION

Figure 1:
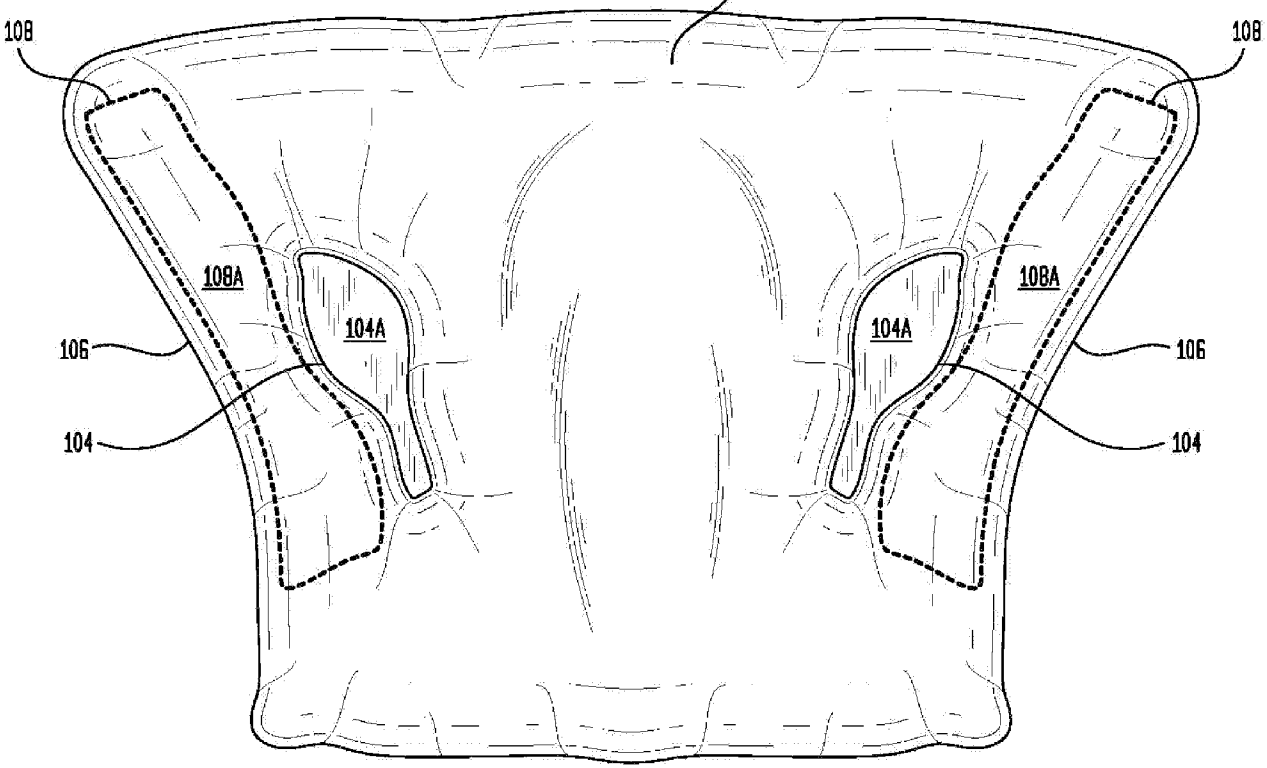
FIG. 1 shows a top view of a pillow in accordance with one aspect of the present invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

As seen in FIG. 1, a pillow 100 in accordance with one aspect of the present invention is generally trapezoidal in shape. The pillow 100 includes a body 102 holding fill material. The body 102 may comprise sewn linen or other suitable material. A pillow case (not shown) may comprise cotton, linen, lyocell (such as Tencel®), suede, silk, spandex, bamboo or other suitable material. The fill material may comprise asynthetic, hypo-allergenic material. Alternatively, the fill material may comprise fiber, fiber in combination with another material such as memory foam, shredded foam, textured memory foam, textured durafoam, beads, durafoam with a textured cool gel top layer or other suitable material.

The pillow 100 may include ear depressions 104 having ear depression surfaces 104*a* formed in the pillow by pleat stitching a front portion of the body 102 to a rear portion of the body 102. The ear depressions 104 may include a section which generally mimics the shape of an ear. In one embodiment, the ear depressions 104 are separated from a lateral edge 106 of the pillow 100 by 2 to 3 inches. In another embodiment, the ear depressions 104 are separated from the lateral edge 106 of the pillow 100 by 2.3 to 2.7 inches. In another embodiment, the ear depressions 104 are separated from the lateral edge 106 of the pillow 100 by 2.5 inches.

The area between the ear depression 104 and the lateral edge 106 forms an angled lateral margin 108 having an angled lateral margin surface 108*a*. The ear depression surfaces 104*a* lie at a lower level than the angled lateral margin surfaces 108*a*.

Figure 2:
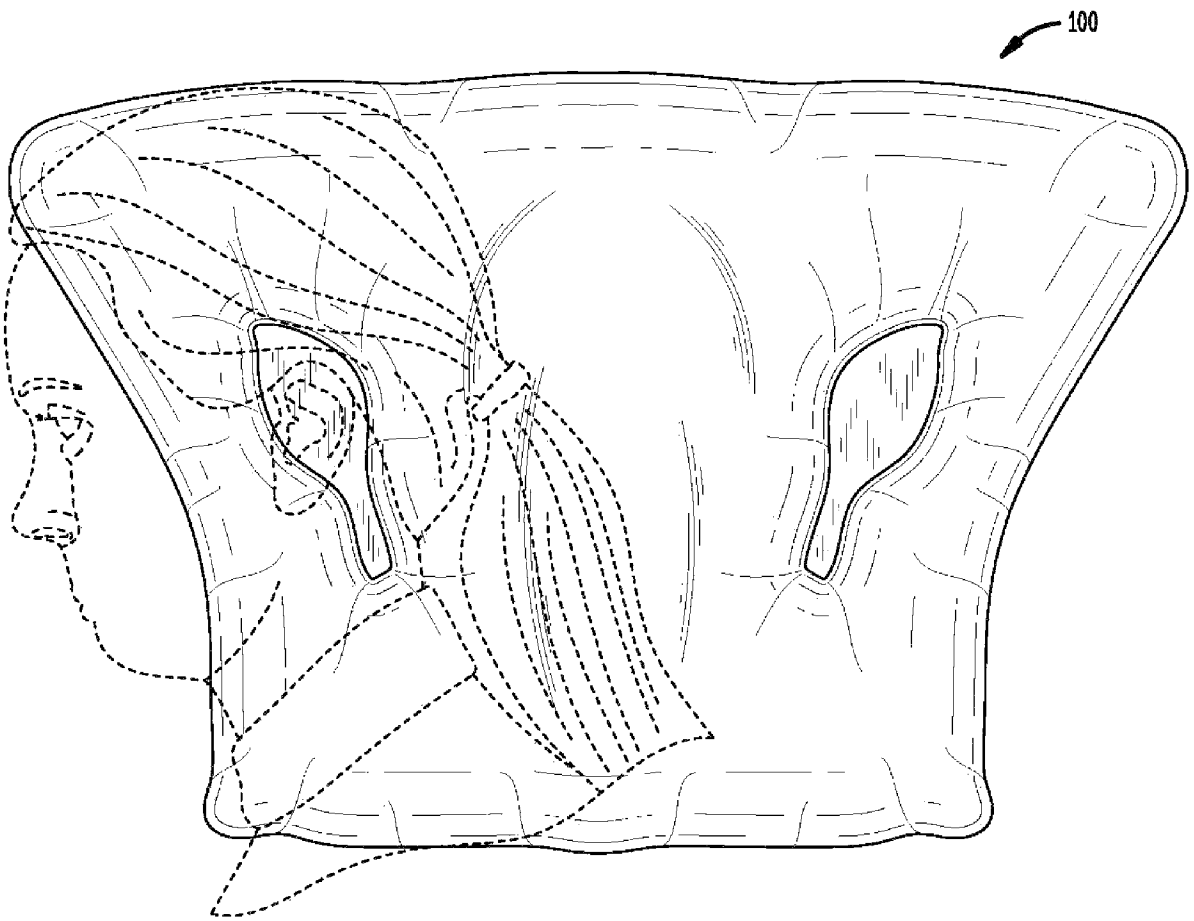
FIG. 2 shows a top view of the pillow of FIG. 1 showing a user in phantom.

To use the pillow, a user places the pillow 100 where the user typically rests their head on a bed, ensuring that the widest part of the pillow 100 is located where the top of the user's head would normally be located. The user then rests their head on the pillow 100 so that the top and back of your head are supported, while no contact is being made with anterior jaw or neck region. See FIG. 2, which shows a top view of an alternate embodiment of the pillow 100 of FIG. 1 showing a user in phantom lying in a side sleeping position with the top portion and back portion of the head supported.

In one aspect of the present invention, the angled lateral margin 108 is disposed to support the head along a line from the forehead, inferiorly through the temporal region and the angle of the mandible, to the lateral neck. The pillow 100 provides support for the face without touching anterior facial surfaces of the mandible and neck. The angled lateral margin 108 supports the users head when an ear is disposed in the ear depression 104. The trapezoidal or butterfly shape of the pillow 100 advantageously supports the user's head without touching the anterior jaw or neck region when properly used. The pillow 100 prevents pressure from being applied to the cheek, frontal jaw and neck. As described above, unwanted pillow contact with these areas while sleeping can be harmful to the results of a facelift for patients who have undergone such a procedure, and can accelerate the appearance of wrinkles when the skin begins to lose elasticity in any person. The pillow 100 allows side sleepers to continue sleeping on their slide without speeding up the aging process, or ruining any facial work they may have already had performed. Unlike a conventional prior art pillow, the pillow 100 preferably avoids contact with all parts of the face, when properly used.

The thickness of the pillow 100 is selected to keep the user's neck in a neutral position for comfort. The ear depression 104 reduces pressure on the user's ear and helps maintains the proper position of the pillow 100 on the head. Additionally, the ear depression 104 could be helpful to patients with other ear problems who need to side sleep. This advantage could be especially helpful to patients with pressure injuries of the ear.

Figure 3:
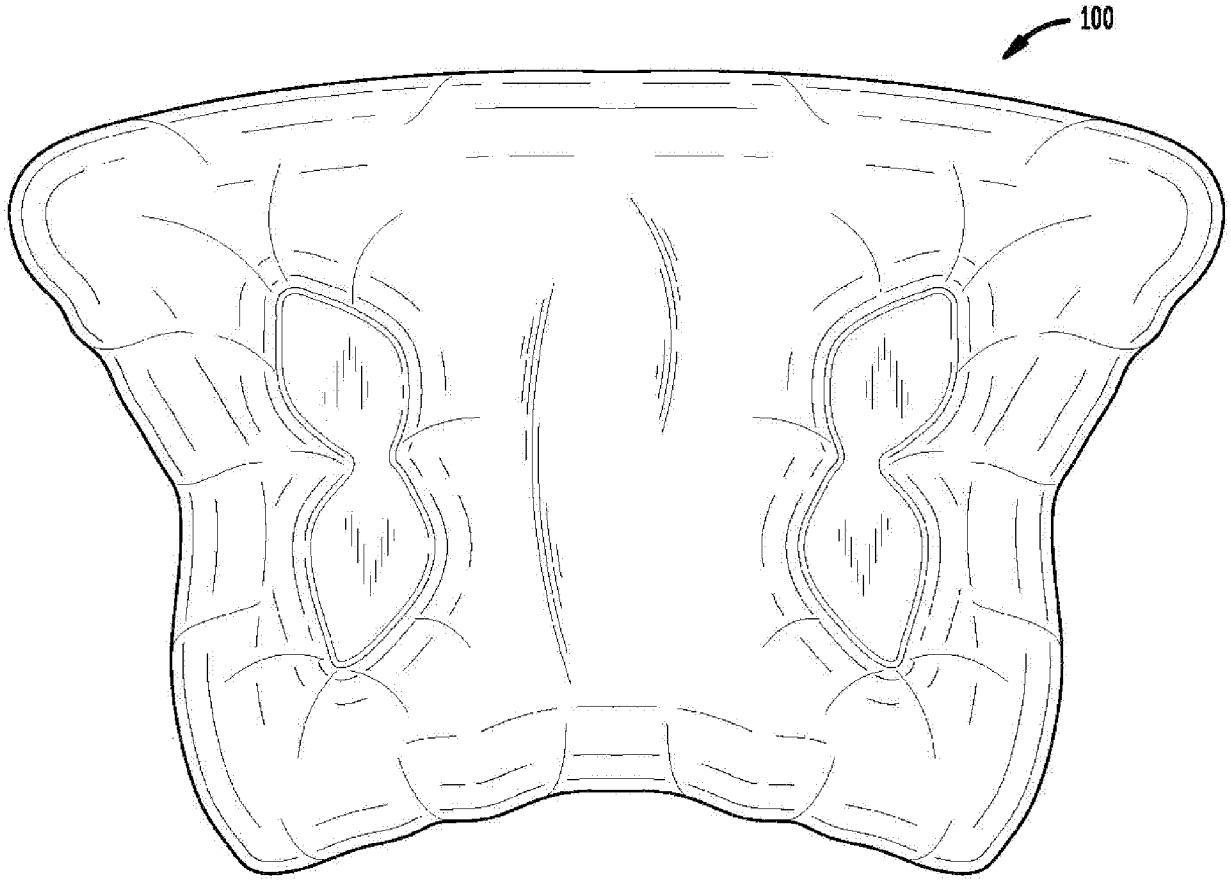
FIG. 3 shows a top view of a pillow in accordance with another aspect of the present invention.

FIG. 3 shows a top view of the pillow 100 in accordance with another aspect of the present invention having alternate shapes for the ear depressions 104.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A pillow for supporting a person's head comprising:

a generally trapezoidal pillow body having a top edge parallel a bottom edge, the top edge being longer than the bottom edge, and two opposing lateral edges which each curve inwardly toward a center of the pillow body from respective opposing terminal ends;

a pair of ear depressions each having an ear depression surface, one of the ear depressions being associated with, separate from, and disposed 2 to 3 inches from a midpoint of one of said lateral edges and the other one of the ear depressions being associated with, separate from, and disposed 2 to 3 inches from a midpoint of the other of said lateral edges;

wherein each ear depression has a lower, generally planar portion and an upper, generally oval portion integral with the lower portion, an overall width of the lower portion being substantially less than an overall width of the upper portion, the ear depressions each being angled outward from the center of the pillow body toward respective top corners of the pillow so as to substantially mirror the curve of an upper half of the respective lateral edges;

a pair of angled lateral margins, each angled lateral margin being associated with one of the lateral edges and extending along at least a majority of a total length of the associated lateral edge, each angled lateral margin being disposed between and proximate to both the associated lateral edge and the ear depression with which said lateral edge is associated, the angled lateral margins each having an angled lateral margin surface lying above said ear depression surfaces;

wherein each angled lateral margin is disposed and configured to support a face of the person's head along a line from a forehead, inferiorly through a temporal region and an angle of a mandible to a lateral neck without touching anterior facial surfaces of the mandible and neck when an ear is disposed in the associated ear depression.

2. The pillow of claim 1, wherein the ear depressions are each disposed 2.3-2.7 inches from the respective associated lateral edge.

3. The pillow of claim 1, wherein the ear depressions are each disposed 2.5 inches from the respective associated lateral edge.

* * * * *